United States Patent [19]

Stefanescu et al.

[11] 4,246,026

[45] Jan. 20, 1981

[54] MANUFACTURING PROCESS OF VERMICULAR GRAPHIC CAST-IRONS THROUGH DOUBLE MODIFICATION

[75] Inventors: Doru M. Stefanescu; Lucian Dinescu; Stefan Craciun; Ioan Cristea, all of Bucharest, Romania

[73] Assignee: Institutul de Cercetari Stiintifice, Inginerie Tehnologica si Proiectari Pentru Sectoare Calde, Bucharest, Romania

[21] Appl. No.: 74,772

[22] Filed: Sep. 12, 1979

[30] Foreign Application Priority Data

Feb. 16, 1979 [RO] Romania ..... 96624

[51] Int. Cl.[3] ..... C22C 33/08

[52] U.S. Cl. ..... 75/130 R; 75/53; 75/130 A; 75/130 B

[58] Field of Search ..... 75/53, 130 R, 130 A, 75/130 B

[56] References Cited

U.S. PATENT DOCUMENTS

| | | | |
|---|---|---|---|
| 3,492,118 | 1/1970 | Mickelson | 75/130 R |
| 3,598,576 | 8/1971 | Moore | 75/130 R |
| 3,955,973 | 5/1976 | Robinson | 75/130 R |

*Primary Examiner*—P. D. Rosenberg
*Attorney, Agent, or Firm*—Karl F. Ross

[57] ABSTRACT

A two-stage method of making vermicular graphite cast iron in which a first alloy is introduced into the ladle into which the iron is cast and then the vermicular graphite level is measured. A second alloy of a compacting or anticompacting nature is then added to ensure a final vermicular graphite level of at least 85% of the total graphite.

8 Claims, No Drawings

MANUFACTURING PROCESS OF VERMICULAR GRAPHIC CAST-IRONS THROUGH DOUBLE MODIFICATION

BACKGROUND OF THE INVENTION

This invention relates to a process for manufacturing vermicular graphite cast-iron by a double modification. Processes for manufacturing vermicular graphite cast-irons are already known. One process modifies the liquid cast-iron in a single phase with modifying alloys which contain both compactizing (Mg, Ce) and anticompactizing (Ti, Al) elements for the graphite. A second known process modifies the iron in a single step with rare-earth elements. A third process is to treat liquid cast iron with metallic zirconium or with an alloy containing zirconium and magnesium.

These processes have the disadvantage that the alloy or modifying element ratio must be adjusted depending on the initial sulphur content of the liquid cast-iron, the modifying temperature and the holding time in the liquid state after modifying, and that inconsistent vermicular graphite ratios in the cast-iron structure result and thus the mechanical characteristics of the poured cast iron are not constant.

SUMMARY OF THE INVENTION

The process for manufacturing vermicular graphite cast-irons through double modification, according to this invention, uses in the first phase of modification an alloy of the Fe Si Mg Ti Al Ce type, which is introduced into the bottom of a pocket ladle where castiron having a temperature of about 1500° C. and a sulphur percentage ranging between 0.01–0.04% is poured, removes the disadvantages mentioned above, that is, in order to obtain some cast-irons having in their structure a minimum of 85% of vermicular graphite and high mechanical characteristics. The first modification of the liquid cast-iron is done by adding 1.1% modifying alloy, followed by a differentiated thermal analysis in order to determine the graphite shape obtained, after which the second modification is done with an addition of 0.25% anticompactizing modifier if the graphite's preponderant shape after the first modification is nodular; usual neutral modifier if the respective graphite shape is vermicular or compactizing modifier if the graphite shape is flaked, after which the obtained cast-iron is poured into parts.

Here is an example of carrying out the invention: A certain quantity of cast-iron was melted in an induction furnace up to a temperature of 1500° C. The liquid cast-iron thus prepared was poured into a pocket ladle of the type of those used in modifying cast-irons by the Sandwich process. Beforehand, the following were put into the pocket: 1.1% modifying alloy with the following chemical composition: 51.8% Si; 2.69% Al; 2.05% Ca; 4.64% Mg; 4.97% Ti; 0.3% Mischmetall, the rest Fe. After completion of the modifying reaction, a sample was taken for the differentiated thermal analysis. The form of the differentiated cooling curve showed that the amount of the nodular graphite in the structure is of 42% and that of the vermicular graphite is of 58% So, the cast-iron had a vermicular graphite content that is too small which should be of a minimum of 85% and a nodular graphite content that was too high. As a consequence, we conducted an anticompactizing post-modification, that is 0.25% of modifying alloy with a chemical composition of 48.4% Si; 0.8% Ca; 8% Ti was introduced after which the cast-iron was poured into parts. The tests made, showed that a vermicular graphite cast-iron with 92% of vermicular graphite in the structure, the rest being nodular graphite having the following mechanical characteristics: tensile strength of 392 N/mm$^2$; elongation 6.4%; hardness 149 HB. If a compactizing post-modification is required instead, a modifying alloy having: 0.5–2% Mg; 0.5–2% Ce; 40–90% Si, and the rest Fe is used in the same conditions. A particularly preferred modifying alloy for anticompacting modification has 1 to 15% Ti; 40 to 90% Si and the rest Fe.

The present invention has the following advantages:

- liquid cast-irons can be used, having a sulphur content ranging between 0.01 and 0.04% at a temperature ranging between 1350° and 1520° C.;
- vermicular graphite cast-irons are obtained with a minimum of 85% of vermicular graphite in the structure, with high mechanical characteristics, constant and reproducible;
- the possible time of waiting after the first modification can be increased before pouring the cast-iron into parts, using a compactizing modifier, added before pouring; and
- the invention allows correction of the graphite shape before pouring the cast-iron into parts, thus reducing considerably the waste ratio, a fact which leads to significant metal savings.

What is claimed is:

1. A process for the preparation of vermicular graphite-containing cast-iron having a minimum graphite content of at least 85% vermicular graphite which comprises the steps of:

(a) forming a melt of cast-iron at a temperature of about 1350° to 1520° C. and having sulfur content ranging between 0.01 and 0.04%;

(b) contacting the melt of castiron formed during step (a) with a modifying alloy comprising Fe, Si, Mg, Ti, Al and Ce to form a modified melt;

(c) subsequent to step (b) taking a sample of the melt and subjecting the sample to differential thermal analysis to obtain a differentiated cooling curve and determine the content of the graphite present therein that is vermicular, the content of the graphite present therein that is nodular and the content of the graphite present therein that is flaked;

(d) when a nodular graphite content is so high that the vermicular graphite content is less than 85%, treating the melt analyzed in step (c) with a sufficient amount of an anticompacting modifier containing silicon, titanium and iron to adjust the content of vermicular graphite to at least 85% of the total graphite present and when the graphite content in flaked form is so high that the vermicular graphite content is less than 85%, treating the melt analyzed in step (c) with a sufficient amount of a compacting modifier to adjust the content of the vermicular graphite to at least 85% of the total graphite present; and (e) pouring the castiron subsequent to step (d).

2. The process defined in claim 1, step (b), wherein the modifying alloy consists by weight essentially of 51.8% Si; 2.69% Al; 2.03% Ca; 4.64% Mg; 4.97% Ti; 0.3% Mischmetall and the balance Fe.

3. The process defined in claim 2, step (d), wherein the anticompacting modifier comprises by weight 48.4% Si; 0.8% Ca and 8% Ti.

4. The process defined in claim 2, step (d), wherein the anticompacting modifier consists by weight essentially of 1 to 15% Ti; 40 to 90% Si and the balance Fe.

5. The process defined in claim 2, step (d), wherein the anticompacting modifier is added in an amount by weight of 0.25% of the melt.

6. The process defined in claim 2, step (d), wherein the compacting modifier consists by weight essentially of 0.5 to 2% Mg; 0.5 to 2% Ce; 40 to 90% Si and the balance iron.

7. The process defined in claim 2, step (d), wherein the compacting modifier is added in an amount by weight of 0.25% of the melt.

8. The process defined in claim 2, step (b), wherein the modifying alloy is added to the melt of castiron so that the amount of modifying alloy added is about 0.1% of the cast-iron melt.

* * * * *